US005658138A

United States Patent [19]

Round et al.

[11] Patent Number: 5,658,138

[45] Date of Patent: Aug. 19, 1997

[54] ROTARY PUMP HAVING INNER AND OUTER COMPONENTS HAVING ABUTMENTS AND RECESSES

[76] Inventors: George F. Round, 1116 Havendale Blvd., Burlington, Ontario, Canada, L7P 3E3; Viljo K. Valavaara, 3939 Lawrence Ave. E., Toronto, Ontario, Canada, L7P 3E3; Lixin Peng, 703-438 Niagara St., Windsor, Ontario, Canada, N9A 3S9

[21] Appl. No.: 553,373

[22] PCT Filed: May 25, 1994

[86] PCT No.: PCT/CA94/00295

§ 371 Date: Mar. 14, 1996

§ 102(e) Date: Mar. 14, 1996

[87] PCT Pub. No.: WO94/28312

PCT Pub. Date: Dec. 8, 1994

[30] Foreign Application Priority Data

May 25, 1993 [CA] Canada ..... 2096856

[51] Int. Cl.[6] ..... F04C 2/08

[52] U.S. Cl. ..... 418/150; 418/171

[58] Field of Search ..... 418/150, 166, 418/171

[56] References Cited

U.S. PATENT DOCUMENTS

| | | | |
|---|---|---|---|
| 448,335 | 3/1891 | Gollings | 418/171 |
| 1,196,315 | 8/1916 | Vincent | 418/171 |
| 1,277,436 | 9/1918 | Lind | 418/167 |
| 4,932,850 | 6/1990 | Valavaara | 418/171 |
| 5,066,207 | 11/1991 | Valavaara | 418/171 |

FOREIGN PATENT DOCUMENTS

| | | | |
|---|---|---|---|
| 2606898 | 9/1977 | Germany | 418/171 |
| 2705256 | 8/1978 | Germany | 418/171 |
| 3238213 | 4/1984 | Germany | 418/166 |
| 395748 | 12/1965 | Switzerland | 418/171 |
| 476515 | 12/1937 | United Kingdom | 418/171 |

OTHER PUBLICATIONS

Pp. 10, 11, 12 and Model Sheet (11, 12, 13) of *Rotary Piston Machines* by Felix Wankel, London Iliffe Books Ltd., 1965.

*Primary Examiner*—John J. Vrablik

[57] ABSTRACT

A rotary pump (10) of the type having inner and outer rotary components (32, 30) which rotate in the same direction at the same speed, the inner rotary component (32) being located within the outer rotary component (30), and in which the outer rotary component (30) has an annular wall (44), abutments (46) and recesses (50) between the abutments (46), and contact bodies (48) formed on the abutments (46) and being shaped as a major segment of an ellipse; and in which the inner rotary component (32) has an inner body (60) with abutments (64) located within respective outer recesses (50), and receiving the outer wall abutments (46) and contact bodies (48), the outer component (30) having a rotary axis, located along its central axis, a drive shaft (36) connected to the inner body (32) and located along its central axis, the outer and inner axes being parallel to and spaced from one another so that the inner component (32) is located offset from the center of the outer component (30), the inner body recess surfaces defining a recess shape in plan, in which any given point around the inner body recess surfaces corresponds to the location of an adjacent point of the corresponding outer contact body (48), when the outer rotor contact body (48) is in contact with the inner rotor recess surface.

7 Claims, 10 Drawing Sheets

ROTARY PUMP HAVING INNER AND OUTER COMPONENTS HAVING ABUTMENTS AND RECESSES

TECHNICAL FIELD

The invention relates to pumps, and in particular to a rotary pump having inner and outer rotary pumping components, with the inner rotary component being located within the outer rotary component, and in which both components rotate at the same speed, in the same direction and in unison with one another.

BACKGROUND ART

Many different designs of rotary pumps exist, some having rotating members which rotate beside one another, known as exterior rotor pumps, and other pumps having only a single rotor. Other rotary devices have two components with unequal numbers of teeth. They rotate at two different speeds. These are generally known as gerotors.

The particular class of pump to which the present invention relates has two rotary components, namely an inner rotary component and an outer rotary component, with the inner rotor being located within the outer rotor. Such pumps are generally known as internal rotor pumps. In this type of pump, both the inner and outer rotor rotate together in unison in the same direction at the same speed. The inner rotor and the outer rotor rotate about respective inner and outer rotor axes which are spaced apart from one another. Thus as the two rotors rotate, the volume defined between the inner and the outer rotors will vary from a minimum to a maximum and back to a minimum.

Generally speaking, such internal rotor pumps are based on a concept in which the inner rotor defines a series of recesses and abutments, and the outer rotor also defines a series of recesses and abutments, and the abutments on the outer rotor fitting within and sweeping around the recesses in the inner rotor, and vice versa.

The problem in the design of all such internal rotor pumps is that of achieving a satisfactory seal between the abutments on one rotor and the surfaces of the other rotor. Such internal rotor pumps are to be distinguished from other rotary devices including proposals for both pumps and motors in which the outer component is stationary, and only the internal rotor rotates. These rotary devices present a somewhat different set of problems since the inner rotor must actually orbit within the outer stationary component.

One form of internal rotor pump is disclosed in U.S. Pat. No. 5,066,207, Inventor V. K. Valavaara. In this design, the abutments on the outer rotor were of cylindrical shape, and the recesses in the inner rotor were of generally semi-cylindrical shape. While this form of internal rotor pump has certain advantages from the viewpoint of manufacturing solutions, in practice, it left certain problems unresolved. In particular, the seals between the inner rotor and the outer rotor were achieved only momentarily. Additional problems were encountered in the volumetric efficiency of the pump. Also the pressures which could be achieved, were not entirely satisfactory.

Another more complex design is shown in U.S. Pat. No. 4,932,850 inventor V. K. Valavaara. This design employs relatively complex shapes for abutments on the inner rotor and also for recesses on the outer rotor. In addition it employs other surfaces of the two rotors to assist in achieving more effective sealing.

This more complex form of rotary pump had an improved performance, and would reach higher pressures. However, its design involved the use of multiple sealing surfaces on the inner and outer rotary components and the manufacture of this pump was consequently somewhat more complex.

An additional feature of such rotary pumps is that the displacement of the pump is essentially a function of the separation of the rotary axes of the inner and outer rotary component. Clearly, the greater the separation between the two axes, the greater is the potential displacement. This in turn affects the efficiency of the pump, as compared with other pumps, of other designs.

The separation of the two axes however has certain practical limits, and there is only a restricted scope for improving pump efficiency simply by increasing the separation. Other principle factors affecting the maximizing of the efficiency of the pump include the shaping of the abutments and recesses of the inner and outer rotors, and the achievement of a satisfactory sealing area as between portions of the inner and outer rotor, at various rotational positions of the two rotors.

DISCLOSURE OF THE INVENTION

With a view to providing an improved rotary pump, the invention comprises a rotary pump of the type having inner and outer rotary components adapted to rotate in the same direction at the same speed with said inner rotary component being located within said outer rotary component, said outer rotary component comprising; an outer annular wall enclosing an internal shape; outer wall abutments on said outer wall extending inwardly and spaced apart radially therearound; a predetermined number of outer wall recesses defined between said outer wall abutments; outer wall contact bodies formed on said outer wall abutments said contact bodies defining a major segment of an ellipse, in plan,; and said inner rotary component comprising; an inner body portion located within said internal space enclosed by said outer wall; a predetermined number of inner body abutments on said inner body portion extending outwardly therefrom and spaced apart radially therearound, said predetermined number of said inner body abutments being equal to said predetermined number of said outer wall recesses, and being located within respective said outer wall recesses; said inner body recesses being bounded by inner recess surfaces, said surfaces being portions of said body member and portions of adjacent said inner abutments and receiving said outer wall abutments and contact bodies; outer component bearing means defining a outer component rotary axis, located along the central axis of said outer component; a drive shaft connected to said inner body portion and aligned on the control axis thereof: inner component bearing means for said for said drive shaft defining a inner component rotary axis located along the central axis of said inner component; said outer and inner component axes being parallel to and spaced from one another whereby said inner component is located offset from the centre of said outer component and said components being co-rotatable about their respective axes; said inner body recess surfaces defining a recess shape in plan, in which any given point around said inner body recess surfaces corresponds to the location of an adjacent point of the corresponding outer wall contact body, when said outer wall contact body is in contact with said inner recess surface.

The invention further comprises such rotary pump wherein said first and second axes lie on an axis of symmetry, bisecting both said inner and said outer components.

The invention further comprises such a rotary pump wherein said inner and outer components define a location of maximum spacing along one end of said axis of symmetry, and a point of minimum spacing therebetween at the other end of said axis of symmetry.

The invention further comprises such a rotary pump wherein each said contact body is in contact with the surface of the respective said inner body recess from a point just after said location of maximum spacing, through said point of minimum spacing, to a point just prior to said location of maximum spacing.

The various features of novelty which characterize the invention are pointed out with more particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

MODES OF CARRYING OUT THE INVENTION

As discussed above, the present invention relates to rotary pumps having inner and outer rotary components, with the inner component being located within the outer component, and in which inner and outer components co-rotate in the same direction and at the same speed.

The embodiment of the pump as illustrated is described here for the purposes of explaining the invention, and without limitation to the details of the construction thereof. It will be appreciated that the actual construction of a pump embodying the invention may vary widely, and the various details are described here merely by way of illustration.

Figure 1:
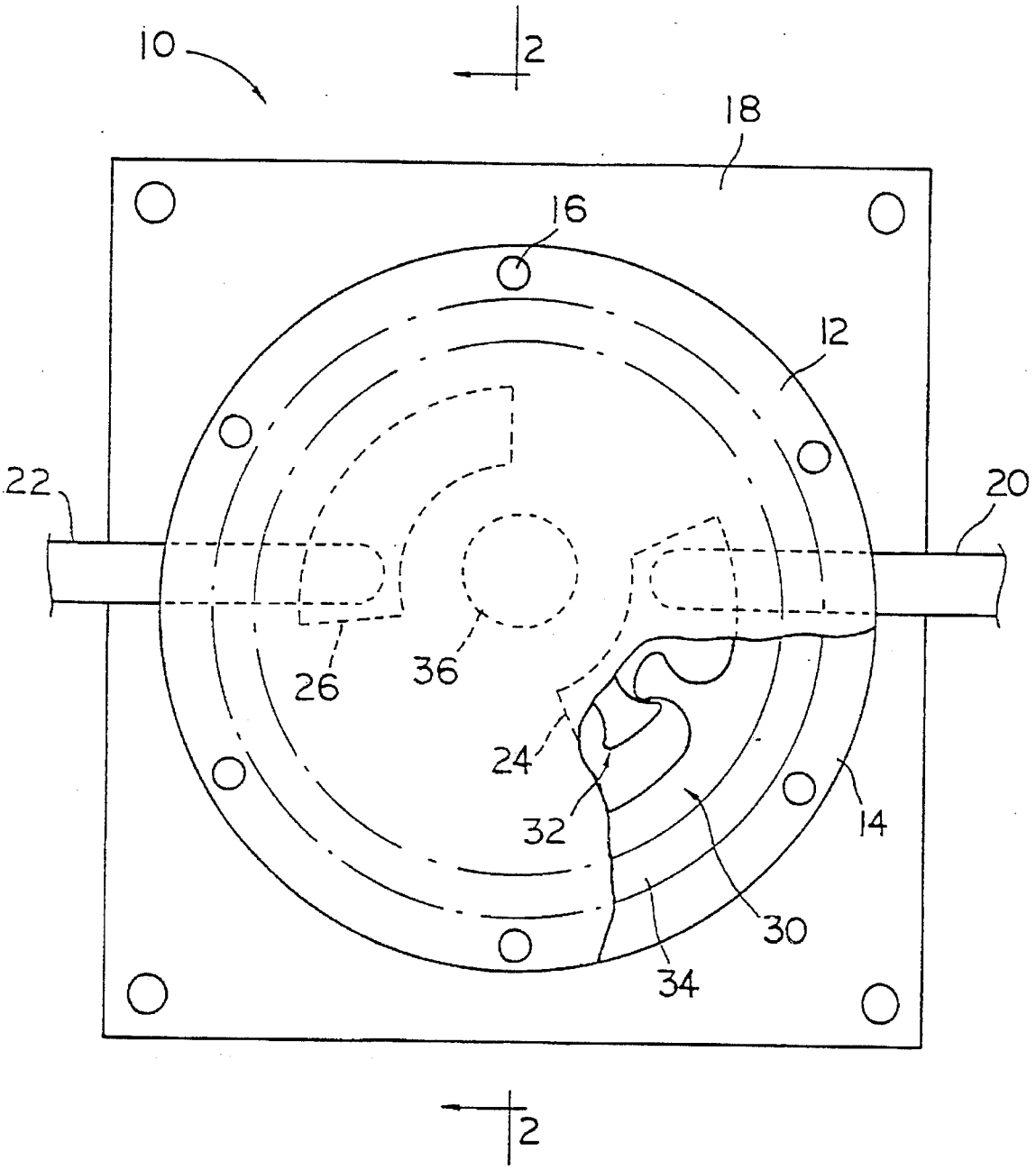
FIG. 1 is a front elevational view of a rotary pump embodying the present invention partially cut away.
Figure 2:
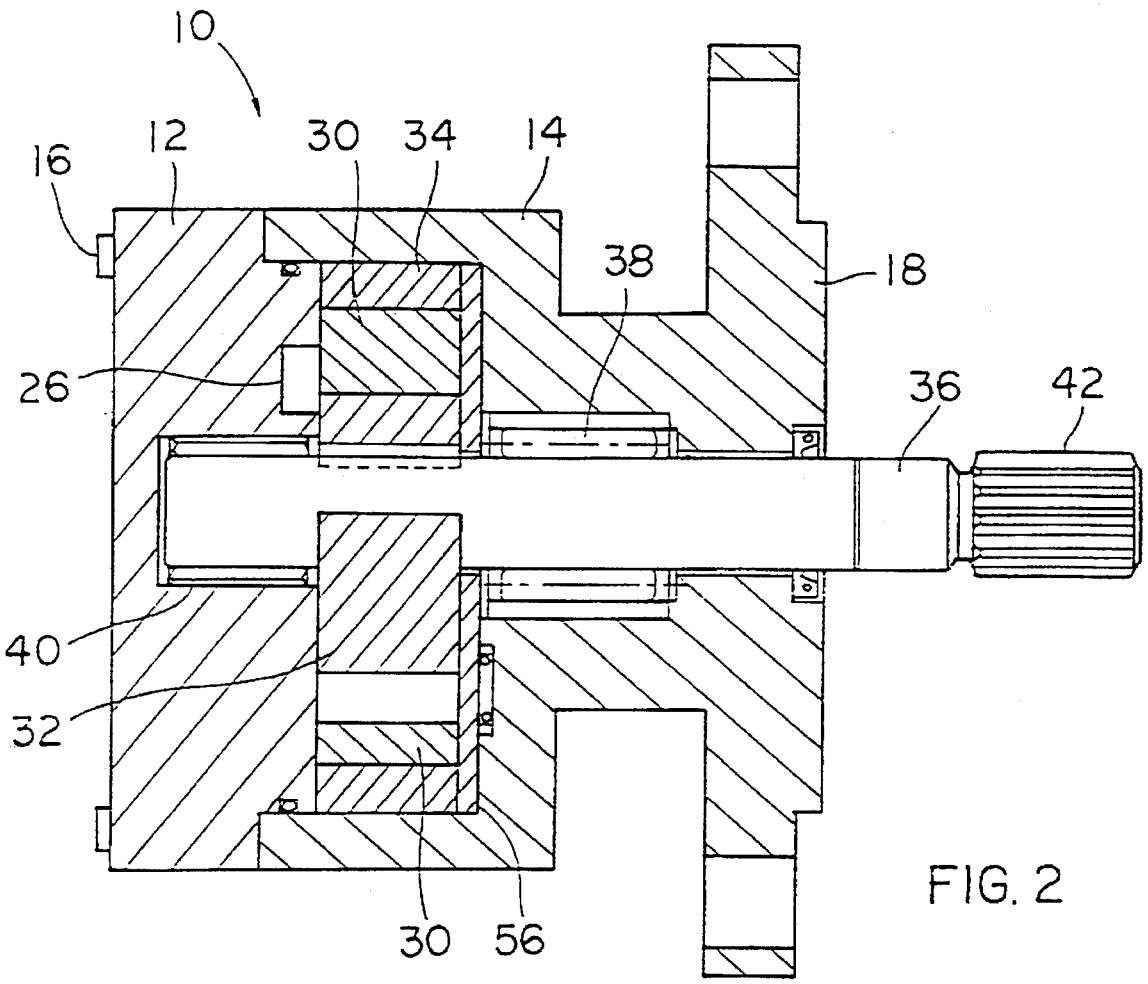
FIG. 2 is a section along the line 2—2 of FIG. 1.

Referring first of all to FIGS. 1 and 2, the pump is indicated by the general reference arrow 10, and comprises a front port plate 12, a rotor housing 14, secured by, eg., bolts 16, and an integral drive bearing plate 18.

Housing 14 defines an internal chamber of circular shape.

Inlet and outlet conduits 20 and 22 are provided communicating with opposite sides of the front plate 12, for communicating a fluid medium, in the case oil or hydraulic fluid, into, and from the pump.

The inlet and outlet conduits are connected to ports 24 and 26 within front plate 12.

Ports 24 and 26 are of arcuate shape, and are located so as to maximize fluid flow efficiency.

Within the chamber of rotor housing 14, there is located an outer rotor 30 and an inner rotor 32. Outer rotor 30 is of circular shape and is rotatably mounted in bearing 34, which is secured within the chamber of rotor housing 14.

Inner rotor 32 is mounted on drive shaft 36. Drive shaft 36 is rotatably mounted in bearing 38 mounted in drive plate 18.

A further bearing 40 in front plate 12 rotatably supports the free end of the drive shaft 36.

The drive shaft is provided with any suitable form of drive transmission means, in this case, the splines 42, by means of which it may be engaged and secured in any suitable drive member such as a drive gear, or pulley, or the like, (not shown).

Figure 3:
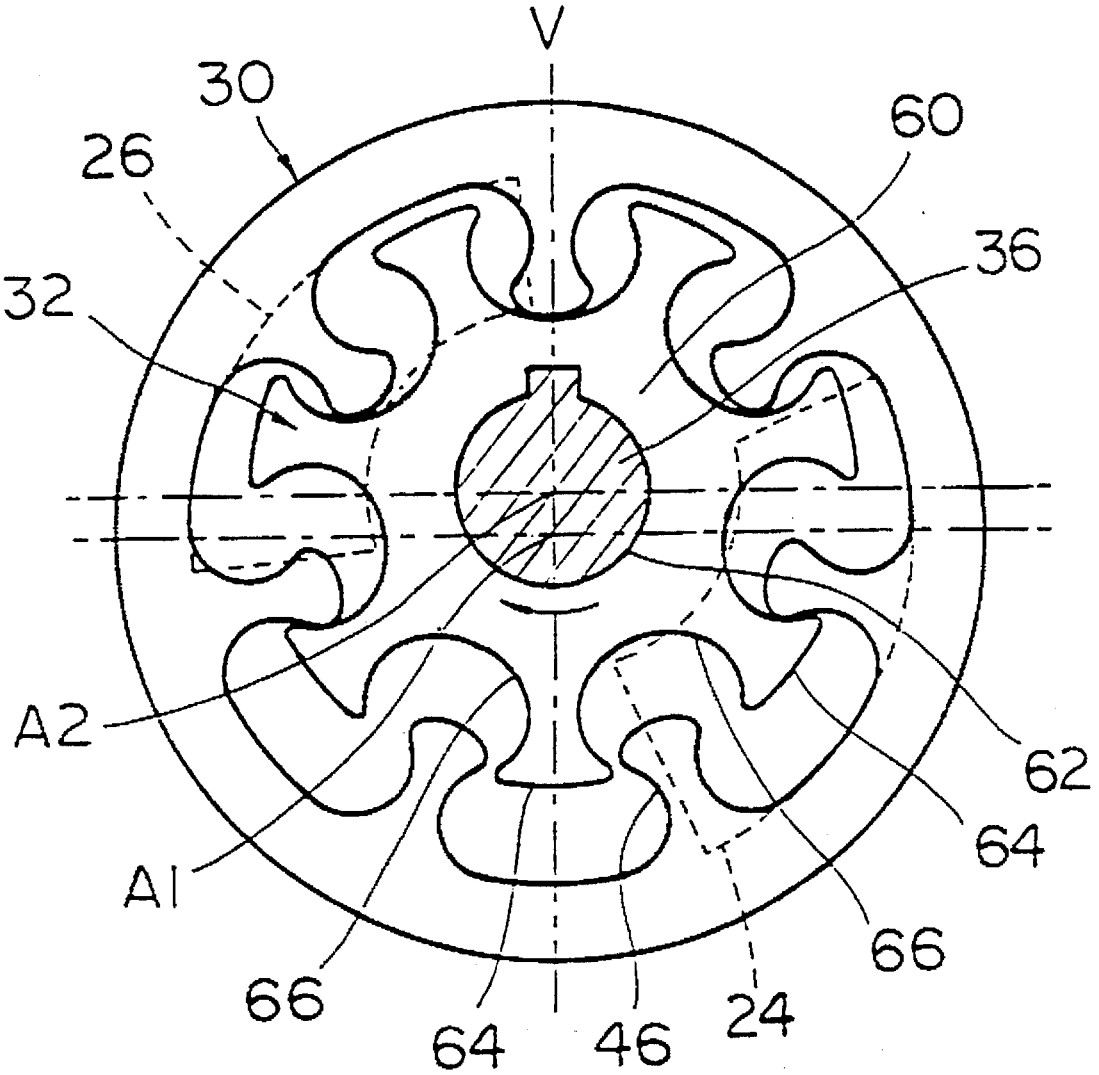
FIGS. 3, 4, 5, are schematic illustrations of the inner and outer rotary components of the pump, showing three different rotational positions.
Figure 4:
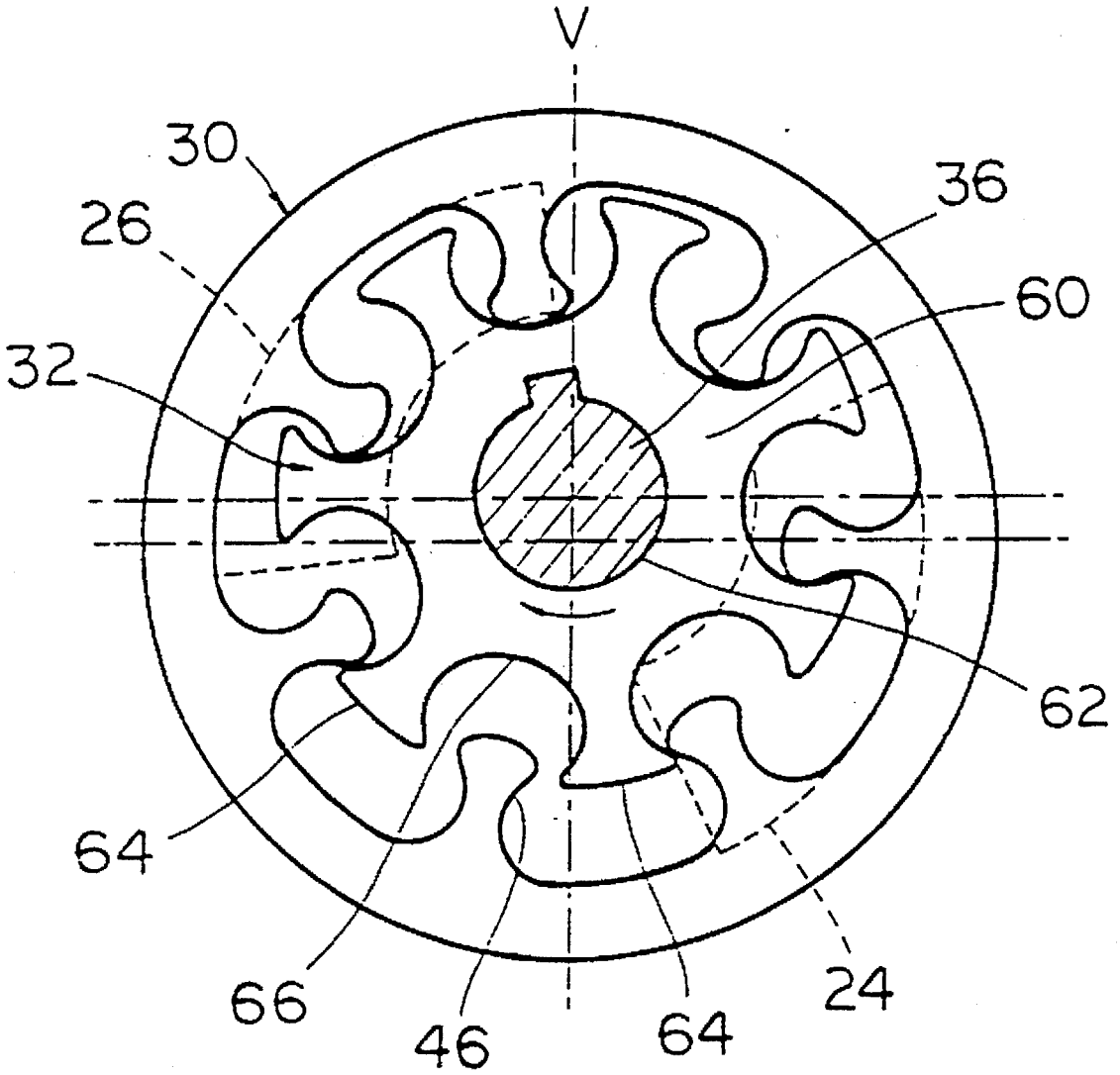
Figure 5:
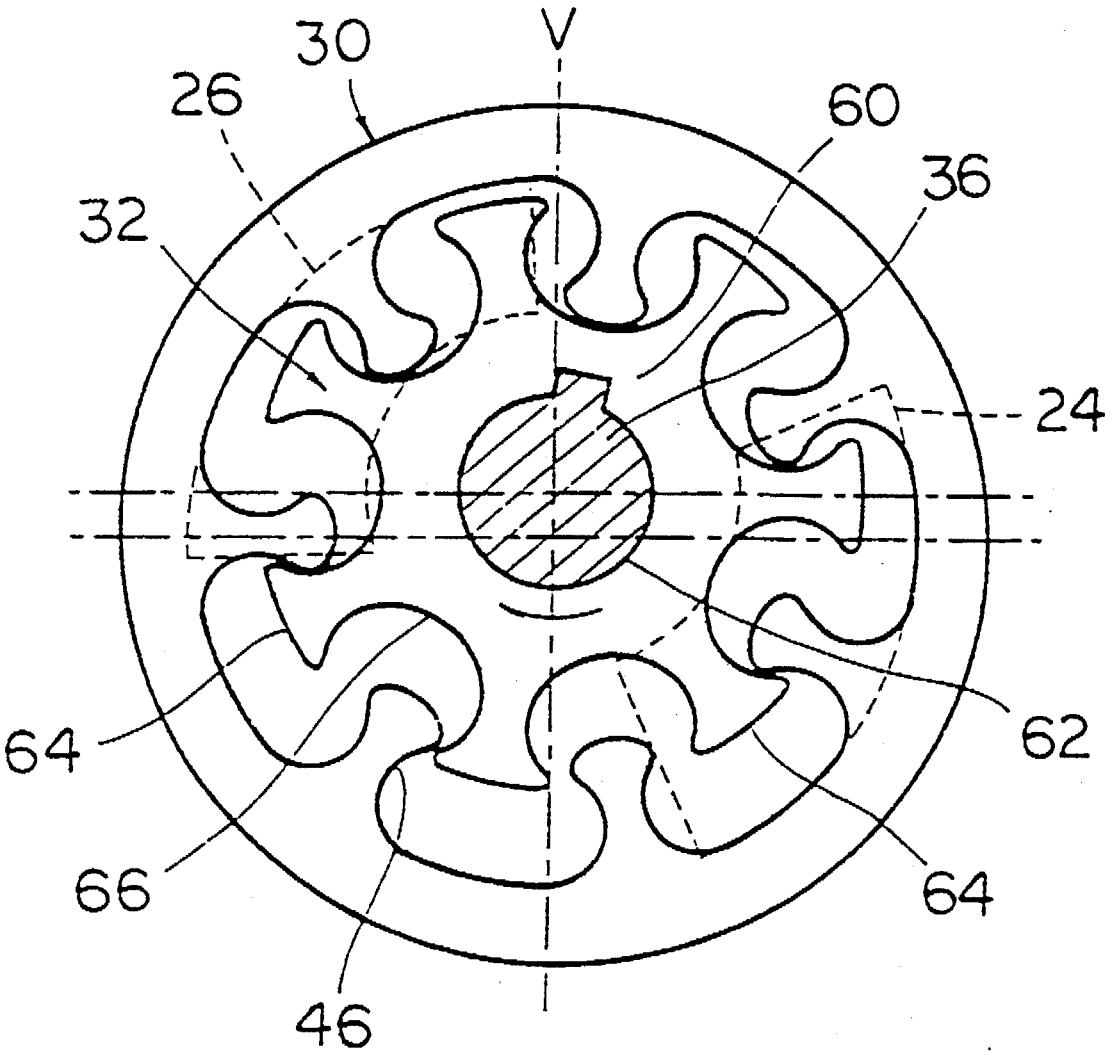

Referring now to FIGS. 3, 4, and 5, it will be observed that the central axis of the outer rotor 30 is indicated as A1, and it will be appreciated that the outer rotor rotates, within bearing 34 about this central axis.

The central axis of the inner rotor 32, and of course of the drive shaft 36, is indicated as A2.

It will thus be seen that the respective axes A1 and A2, of the outer rotor and of the inner rotor, are offset relative to one another. The offsetting of these two axes A1 and A2, as will be explained, produces the "displacement" of the pump, in a manner to be described below.

The locations of the ports 24 and 26 are shown in phantom.

The outer rotor 30 will be seen to comprise an outer annular wall 44, the exterior surface of which is cylindrical, so as to be rotatably received in the bearing 34.

Within the annular wall 44, there are integrally formed a plurality of abutments 46. On the inwardly extending free end of each abutment, there is formed a contact body 48, of a predetermined shape.

Between adjacent abutments 46, outer wall recesses 50 are formed, the inwardly directed surfaces of which comprise portions of the outer wall, and portions of the side surfaces of the adjacent abutments 46.

The contact bodies 48 define a shape in plan which is a major segment of an ellipse. By the term a major segment, is meant a segment extending around an arc greater than 180°.

Figure 6:
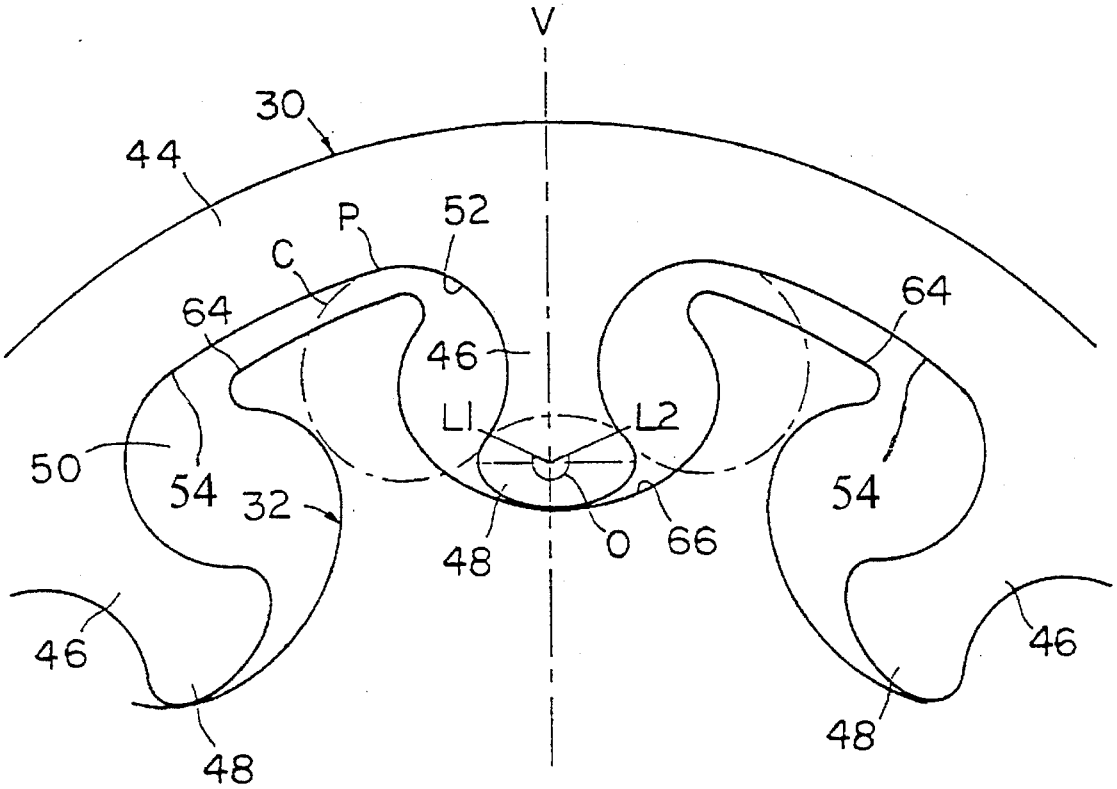
FIG. 6 is a greatly enlarged sectional illustration showing a detail of a portion of the outer rotor.
Figure 7:
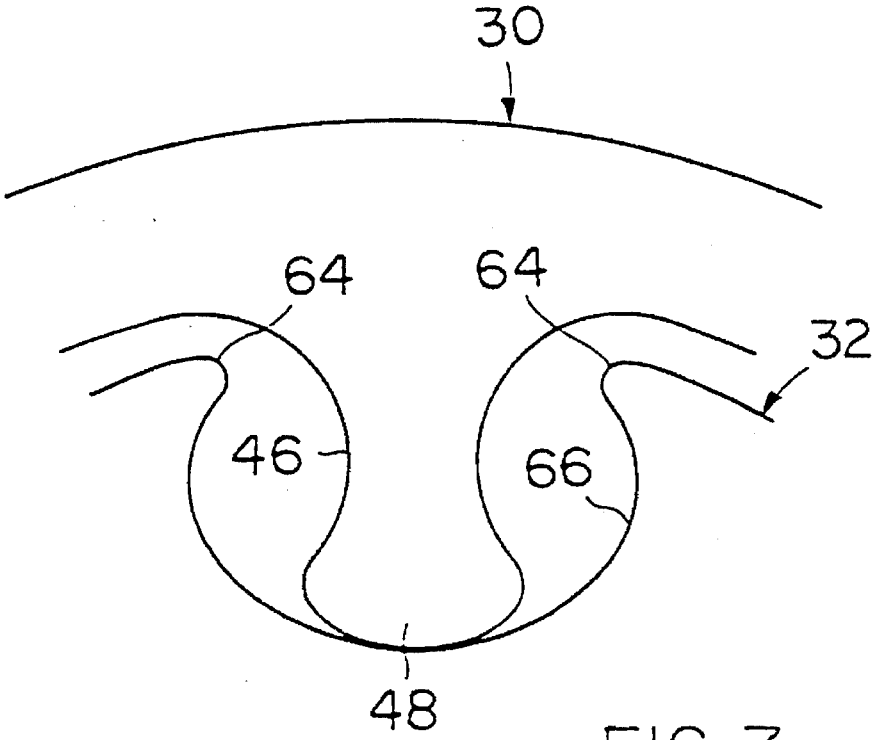
FIGS. 7, 8, 9, 10, 11, 12, 13 and 14 are enlargened drawings of portions of the inner and outer rotary components, at the various rotational positions shown in FIGS. 3, 4, and 5.
Figure 8:
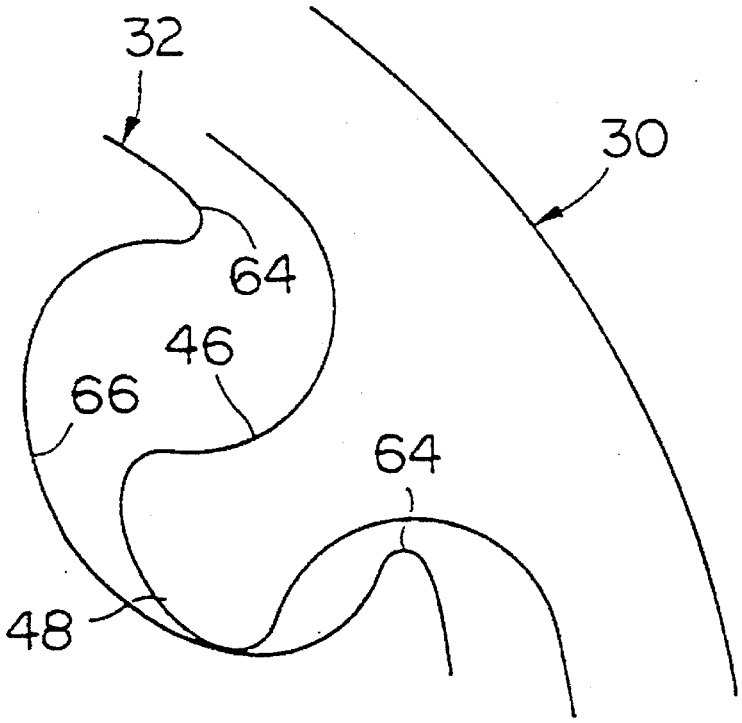
Figure 9:
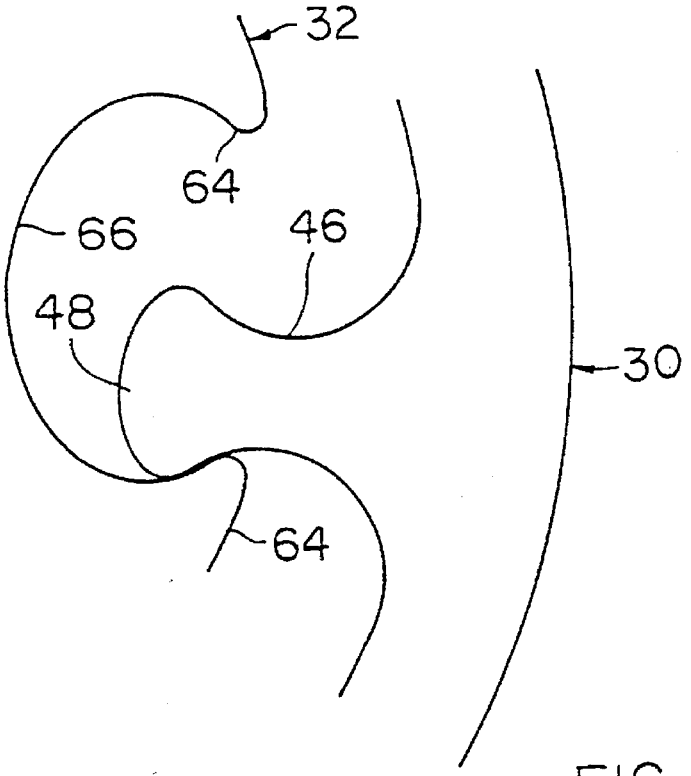
Figure 10:
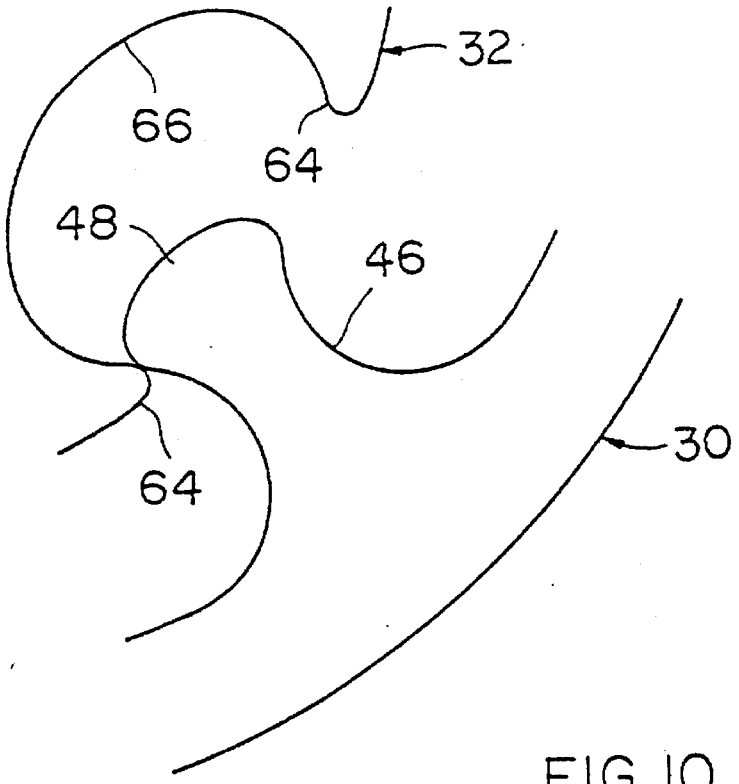
Figure 11:
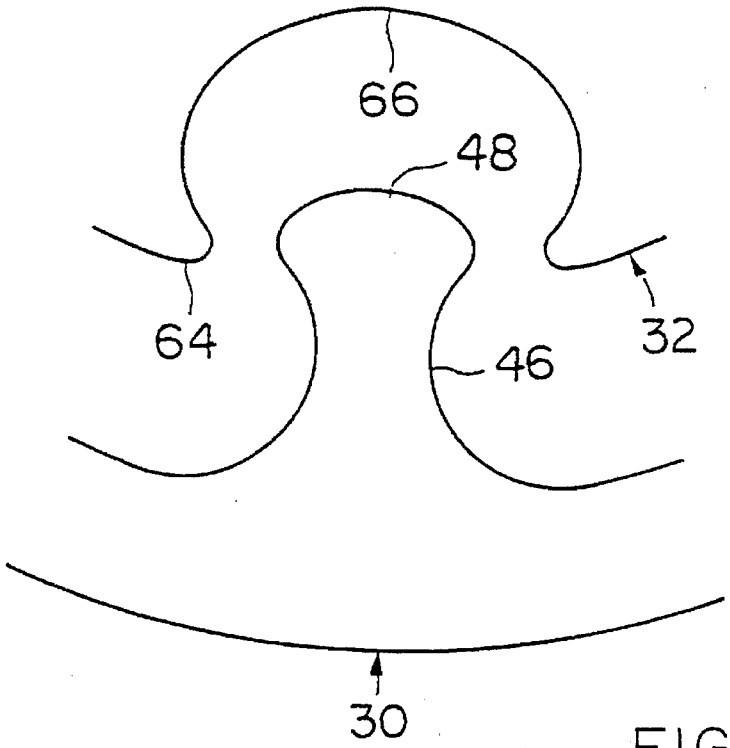
Figure 12:
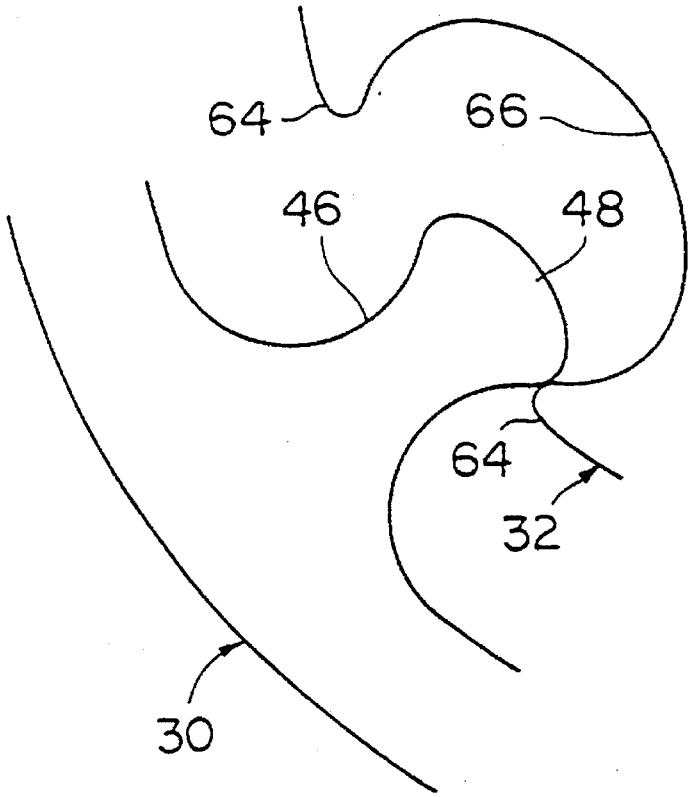
Figure 13:
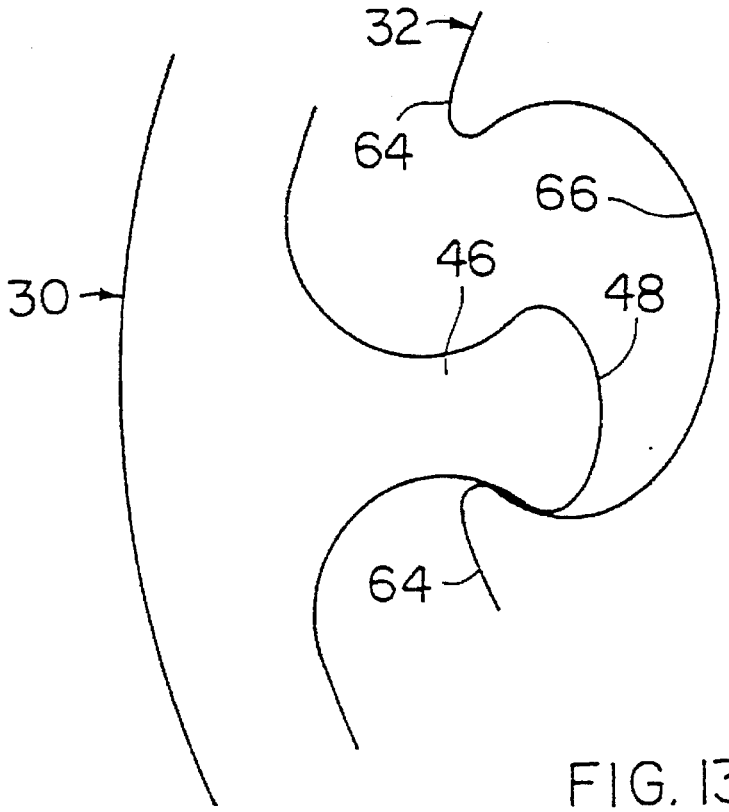
Figure 14:
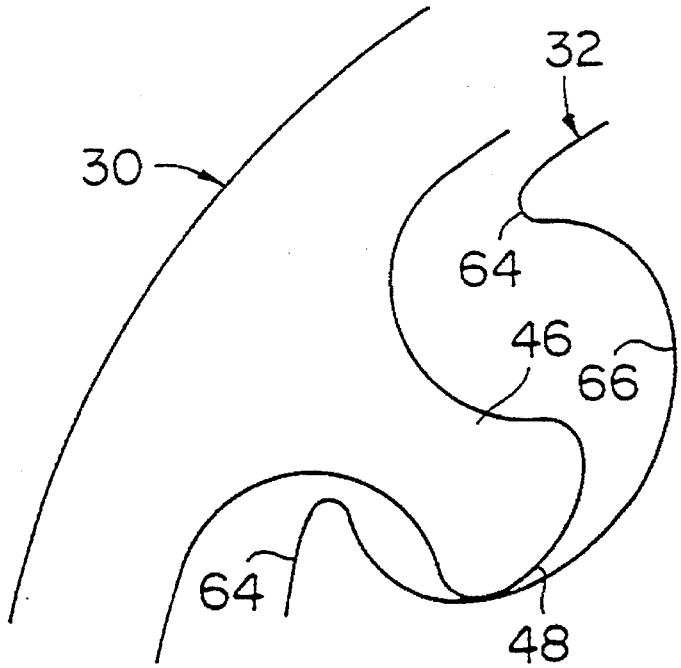

The actual complete ellipse shape is shown in phantom at E in FIG. 6, with the extent of the elliptic arc being indicated by two lines L1 and L2. The lines L1 and L2 meet along at a point located between the two centres of the ellipse, aligned along an imaginary diameter of the ellipse, and in fact, define an obtuse angle O.

In this embodiment there are seven abutments 46 and seven recesses 50. When one abutment 46 is at the "top" (FIG. 3) a vertical axis V will bisect that abutment 46, and the recess 50 at the "bottom".

It will thus be appreciated that the outer rotor is symmetrical about such axis V. Thus it is inherently "in balance" as it rotates.

The "top" and "bottom" positions in FIG. 3 are the points of minimum, and maximum spacing between the inner and outer rotors.

The side surfaces 52 of the abutments 46 are formed as minor arcs of a circle C (FIG. 6) which commence at the ends of the arc of the elliptical-shape of the contact bodies 48, at the points L1 or L2, and extend for less than 180°, and terminate at the point P where they merge with the inside surfaces 54 of outer wall 44.

As will be apparent from the section drawing of FIG. 2, the outer rotor 30 is open on both sides, with the abutments 46 and the contact bodies 48 extending from side to side. A wear plate 56 is located within rotor housing 14, to contact the one side of the outer rotor 30, and the inner rotor 32. The wear plate is made of a substance softer than that of the outer and inner rotors. In this case the wear plate is made copper, and is intended to be replaced from time to time. In this way wear on the actual outer and inner rotors themselves is maintained at a minimum.

The inner rotor 32 is formed with a central body 60, having a central bore 62 for shaft 36.

The inner rotor 32 is formed with abutments 64, which extend into the corresponding recesses 50 of the outer rotor 30. Between the abutments 64, inner body recesses 66 are formed, which receive the contact bodies 48 and abutments 46 of the outer rotor 30. The inner rotor recesses 66 are formed around an arc which is substantially, but not precisely a portion of an ellipse, and is so formed that the contact body 48 within any one recess makes a surface to surface contact with that recess around substantially three quarters of the rotational path of the inner and outer rotors. In fact, separation of the contact body from the surface of its respective recess occurs only just prior to and during and just after the "bottom" position of the two rotors as shown in FIGS. 3, 4, and 5.

The ports 24 and 26, which are in fact formed in the interior of the front plate 12, are shown in phantom in FIGS. 3, 4, and 5 to show the relationship between the ports and the inner and outer rotors. Thus it will be seen that the inlet port 24 extends from a point just before the mid-point between the "top" and "bottom" positions of the rotors, around an arc which terminates just prior to the "bottom" position. The outlet port 26 extends from a point approximately at or slightly before the mid-point between the bottom and top locations of the two rotors, and extends around an arc which terminates just prior to the "top" position of the rotors. Between the end of the inlet port 24 in the beginning of the outlet port 26, the rotors 30 and 32 are effectively sealed by the front plate 12. Similarly, between the end of the outlet port 26 in the beginning of the inlet port 24, the rotors are also effectively sealed by the plate 12.

This explanation rotation is clockwise, as shown by the arrows in FIGS. 3, 4, and 5.

In practice, the "sealing" between the front plate 12 and the rotors is a hydraulic seal, ie there is a film of hydraulic fluid always present between the plate 12 and the rotors 30 and 32 so as to avoid rubbing contact between the rotors and the front plate 12.

The manner in which each of the contact bodies 48 traverses around its respective recess 66 is best understood with reference to FIGS. 7 through 14. It will be seen that at least at the "top" of the rotors, and for a substantial arc on either side thereof, the elliptical shape of the contact bodies 66 achieves a substantial area of sealing thus maximizing the efficiency of the pump.

The foregoing is a description of a preferred embodiment of the invention which is given here by way of example only. The invention is not to be taken as limited to any of the specific features as described, but comprehends all such variations thereof as come within the scope of the appended claims.

We claim:

1. A rotary pump (10) of the type having inner and outer rotary components (32, 30) adapted to rotate in the same direction at the same speed with said inner rotary component (32) being located within said outer rotary component (30), and housing inlet and outlet port means (24, 26) for flow of fluid to and from said rotary pump, said outer rotary component (30) having an outer annular wall (44) enclosing an internal space, outer wall abutments (46) on said outer wall extending inwardly and spaced apart radially therearound, a predetermined number of outer wall recesses (50) defined between said outer wall abutments (46), outer wall contact bodies (48) formed on said outer wall abutments (46), and said inner rotary component (32) having an inner body portion (60) located within said internal space enclosed by said outer wall, a predetermined number of inner body abutments (64) on said inner body portion (60) extending outwardly therefrom and spaced apart radially therearound, said predetermined number of said inner body abutments (64) being equal to said predetermined number of said outer wall recesses (50), and being located within respective said outer wall recesses (50), inner body recesses (66) being bounded by inner recess surfaces, said surfaces being portions of said inner body portion and portions of adjacent said inner abutments (64) and receiving said outer wall abutments (46), outer component bearing means (34) defining an outer component rotary axis, located along the central axis of said outer component, a drive shaft (36) connected to said inner body portion (60) and aligned on the central axis thereof, inner component bearing means (40) for said drive shaft defining an inner component rotary axis located along the central axis of said inner component, said outer and inner component axes being parallel to and spaced from one another whereby said inner component (32) is located offset from the centre of said outer component (30) and said components being co-rotatable about their respective axes and defining a location of minimum spacing between respective rotors;

and characterised by;

said outer wall contact bodies (48) defining a major segment of an ellipse, in plan, said inner body recess surfaces defining a recess shape, in plan, in which any given point around said inner body recess surfaces corresponds to the location of an adjacent point of the corresponding outer wall contact body (48) when said outer wall contact body (48) is in contact with said inner recess surface.

2. A rotary pump (10) as claimed in claim 1 wherein said first and second axes lie on an axis of symmetry, bisecting both said inner and said outer components (32, 30).

3. A rotary pump (10) as claimed in claim 2 wherein said inner and outer components (32, 30) define a location of maximum spacing along one end of said axis of symmetry, and a point of minimum spacing therebetween at the other end of said axis of symmetry.

4. A rotary pump (10) as claimed in claim 3 wherein each said contact body (48) is in contact with the surface of the respective said inner body recess (66) from a point just after said location of maximum spacing, through said point of minimum spacing, to a point just prior to said location of maximum spacing.

5. A rotary pump (10) as claimed in claim 1 wherein said outer rotor recesses (50) are defined by side surfaces of said abutments (46), said side surfaces defining arcs of a circle, and said side surfaces merging with said outer wall number of said outer rotor, whereby said outer rotor abutments (46) define side surfaces which are concave on opposite sides, and with said contact bodies (48) being located on ends of respective abutments (46), with the curvature of said side surfaces meeting emerging with said elliptical segment shape of said contact bodies.

6. A rotary pump (10) as claimed in claim 1 and including plate means (12), adjacent one side of said inner and outer rotor component (32, 30), and said inlet and outlet port means (24, 26) being formed in said port plate (12), and extending around predetermined arcs of rotation of said inner and outer components (32, 30).

7. A rotary pump (10) as claimed in claim 1 and wherein said inlet port (24) extends around an arc of about 90°, and terminates prior to said point of maximum spacing, and wherein said outlet port (26) extends around an arc of substantially 90° and terminates just prior to said point of minimum spacing.

* * * * *